US008382006B2

(12) United States Patent
Gebhardt et al.

(10) Patent No.: US 8,382,006 B2
(45) Date of Patent: Feb. 26, 2013

(54) FUEL INJECTOR ASSEMBLY

(76) Inventors: Jens Gebhardt, St. Egidien (DE); Martin Luedicke, Columbia, SC (US); Bernd Niethammer, Schierling (DE); Greg Hafner, Blythewood, SC (US); Robert Roy, Blythewood, SC (US)

( * ) Notice: Subject to any disclaimer, the term of this patent is extended or adjusted under 35 U.S.C. 154(b) by 284 days.

(21) Appl. No.: 12/617,454

(22) Filed: Nov. 12, 2009

(65) Prior Publication Data

US 2010/0219266 A1 Sep. 2, 2010

Related U.S. Application Data

(63) Continuation-in-part of application No. 10/396,364, filed on Mar. 26, 2003, now abandoned.

(60) Provisional application No. 60/382,044, filed on May 22, 2002.

(51) Int. Cl.
*F02M 47/02* (2006.01)

(52) U.S. Cl. ..... 239/88; 239/585.1; 251/129.09

(58) Field of Classification Search ..... 251/129.09, 251/129.1; 137/625.69; 239/88, 585.1–585.5
See application file for complete search history.

(56) References Cited

U.S. PATENT DOCUMENTS

| | | | | |
|---|---|---|---|---|
| 5,033,716 | A | 7/1991 | Mesechin | |
| 5,460,329 | A | 10/1995 | Sturman | |
| 5,598,871 | A | 2/1997 | Sturman et al. | |
| 5,992,821 | A | 11/1999 | Rookes et al. | |
| 6,012,644 | A | 1/2000 | Sturman et al. | |
| 6,026,785 | A | 2/2000 | Zuo | |
| 6,105,616 | A | 8/2000 | Sturman et al. | |
| 6,345,804 | B1 | 2/2002 | Martin et al. | |
| 6,422,488 | B1 | 7/2002 | Fochtman et al. | |
| 6,631,853 | B2 | 10/2003 | Lenk et al. | |
| 6,715,694 | B2 | 4/2004 | Gebhardt | |
| 6,913,212 | B2 * | 7/2005 | Augustin | 239/585.1 |
| 2002/0017573 | A1 | 2/2002 | Sturman | |

FOREIGN PATENT DOCUMENTS

| | | |
|---|---|---|
| DE | 199 08 420 A1 | 5/2000 |
| EP | 1365141 | 11/2003 |
| JP | 2006 336492 | 12/2006 |

OTHER PUBLICATIONS

International Search Report mailed on Jun. 27, 2011 on related PCT application PCT/US2010/056550.

* cited by examiner

*Primary Examiner* — Christopher Kim
(74) *Attorney, Agent, or Firm* — McGuireWoods, LLP; Charles J. Gross

(57) ABSTRACT

A control valve includes a main body, the first coil assembly arranged on the first side of the main body and having the first contact surface and the first through hole extending from the first contact surface, the second coil assembly arranged on the second side of the main body and having the second contact surface and the second through hole extending from the second contact surface, and a spool arranged within the main body and configured to move between the first and second contact surfaces. The spool has the third contact surface facing the first contact surface, the fourth contact surface facing the second contact surface, and the third through hole extending from the third contact surface to the fourth contact surface. A surface pattern is formed on one or more of the first, second, third and fourth contact surfaces and includes the first recessed portion substantially extending from an inner circumference to an outer circumference of the corresponding one of the first, second, third and fourth contact surfaces.

20 Claims, 15 Drawing Sheets

FUEL INJECTOR ASSEMBLY

CROSS REFERENCE TO PRIOR APPLICATIONS

This application is a Continuation-In-Part Application of a co-pending U.S. patent application Ser. No. 10/396,364, filed on Mar. 26, 2003, which claims priority and the benefit thereof from U.S. Provisional No. 60/382,044, filed on May 22, 2002, both of which are hereby incorporated by reference for all purposes as if fully set forth herein.

BACKGROUND OF THE DISCLOSURE

1. Field of the Disclosure

The disclosure generally relates to fuel injectors and, more particularly, to reducing or eliminating latching effects in control valves of the fuel injectors.

2. Related Art

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid capable of providing a pressure within the fuel injector in order to begin the process of injecting fuel into the combustion chamber.

In conventional designs, a driver delivers a current or voltage to an open solenoid coil assembly. The magnetic force generated in the open solenoid coil assembly shifts a spool into an open position so as to align grooves or orifices (hereinafter referred to as "grooves") of the control valve body and the spool. The alignment of the grooves permits the working fluid to flow into an intensifier chamber from an inlet portion of the control valve body (via working ports). The high-pressure working fluid then acts on an intensifier piston to compress an intensifier spring and hence compress fuel located within a high-pressure plunger chamber. As the pressure in the high-pressure plunger chamber increases, the fuel pressure begins to rise above a needle check valve opening pressure. At the prescribed fuel pressure level, the needle check valve shifts against a needle spring and opens an injection hole in a nozzle tip. The fuel is then injected into the combustion chamber of the engine.

However, in such conventional systems, over time, changes in latching effects between the spool and the solenoids coil assembly retard the injection start due to a delayed motion of the spool in the opening direction. For example, the spool may temporarily latch to the solenoid coil assembly, which delays the spool from moving. In this manner response times between the injection cycles may be slowed, thus decreasing the efficiency of the fuel injector. It has been further found that this reduced efficiency has increased at higher rail pressures. Time delays regarding first injection events at the pulse width map are also frequently observed. This reduction of the fuel quantity may also be accompanied by higher shot to shot variation. Also, fuel deterioration is potentially caused by small changes of about a 0.5 μm wear on the surfaces between the spool and the solenoid coil assemblies in combination with oil present in the solenoid coil assemblies.

Accordingly, there is a need for overcoming one or more of the problems as set forth above.

SUMMARY OF THE DISCLOSURE

The disclosure meets the foregoing need and eliminates delays in spool movement over time, which results in increased fuel injector efficiency and other advantages apparent from the discussion herein.

Accordingly, in one aspect of the disclosure, a control valve includes a main body, the first coil assembly arranged on the first side of the main body and having the first contact surface and the first through hole extending from the first contact surface, the second coil assembly arranged on the second side of the main body and having the second contact surface and the second through hole extending from the second contact surface, a spool arranged within the main body and configured to move between the first and second contact surfaces. The spool has the third contact surface facing the first contact surface, the fourth contact surface facing the second contact surface, and the third through hole extending from the third contact surface to the fourth contact surface. A surface pattern is formed on one or more of the first, second, third and fourth contact surfaces and includes the first recessed portion substantially extending from an inner circumference to an outer circumference of the corresponding one of the first, second, third and fourth contact surfaces.

According to another aspect of the disclosure, a control valve includes a main body, the first coil assembly arranged on the first side of the main body and having the first contact surface and the first through hole extending from the first contact surface, the second coil assembly arranged on the second side of the main body and having the second contact surface and the second through hole extending from the second contact surface, a spool arranged within the main body and configured to move between the first and the second contact surfaces. The spool has the third contact surface facing the first contact surface, the fourth contact surface facing the second contact surface and the third through hole extending from the third contact surface to the fourth contact surface. A surface pattern is formed on one or more of the first, second, third and fourth contact surfaces and includes the first recessed portion having in a cross shape.

In yet another aspect of the disclosure, a replacement spool for replacing an existing spool of a fuel injector includes a main body, the first contact surface arranged at the first end of the main body, the second contact surface arranged at the second end of the main body, a through hole extending between the first and second contact surfaces, and a surface pattern formed on at least one of the first and second contact surfaces and having a recessed portion substantially extending from an inner circumference to an outer circumference of the corresponding one of the first and second contact surfaces.

In yet another aspect of the disclosure, a replacement coil assembly for replacing an existing coil assembly of a fuel injector includes a main body having the first side and the second side, a contact surface arranged at the first side of the main body, a through hole extending through the main body from the contact surface, and a surface pattern formed on the contact surface and having a recessed portion substantially extending from an inner circumference to an outer circumference of the contact surface.

In yet another aspect of the disclosure, a control valve includes a control body, the first coil assembly positioned at the first side of the control body and having the first surface, the second coil assembly positioned at the second side of the control body and having the second surface, and a spool positioned within the control body and configured to move between the first and second surfaces. The spool has the third surface facing the first surface, the fourth surface facing the second surface and a through hole extending from the third surface to the fourth surface. At least one of the first, second, third and fourth surfaces has a surface configuration having a main surface portion and a slot longitudinally extending over an entire diameter thereof of the surface configuration except for the through hole, thereby dividing the main surface portion into two halves.

In yet another aspect of the disclosure, a fuel injector includes a control valve having an inlet port and working ports, the first coil assembly on the first side of the control valve and having the first surface, the second coil assembly on the second side of the control valve and having the second surface, a spool positioned within the control valve and configured to move between the first and second surfaces and having the third surface facing the first surface, the fourth surface facing the second surface and a through hole extending from the third surface to the fourth surface, an intensifier chamber having a piston and plunger assembly and being in fluid communication with the working ports, a high pressure fuel chamber arranged below a portion of the plunger assembly, and a needle chamber having a needle responsive to an increased fuel pressure created in the high pressure fuel chamber. At least one of the first, second, third and fourth surfaces has a surface configuration including a main surface portion and a slot longitudinally extending over an entire diameter thereof of the surface configuration except for the through-hole, thereby dividing the main surface into two halves.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1B:
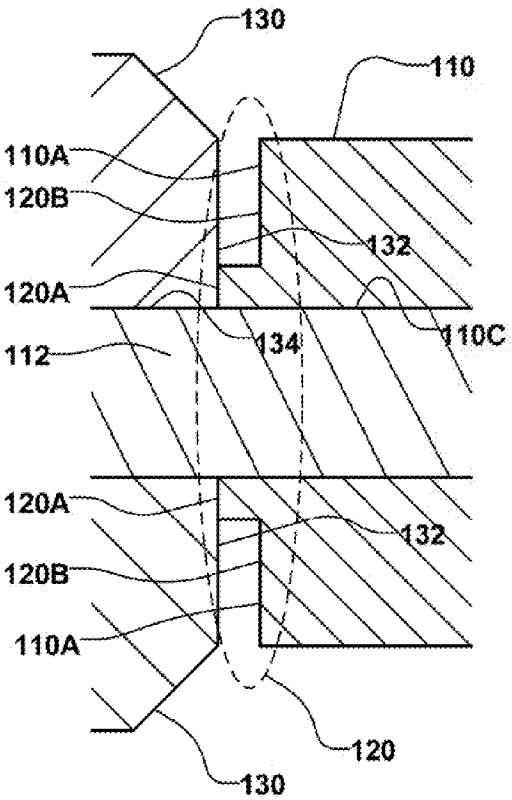
FIG. 1*b* shows an enlarged view of box A shown in FIG. 1*a;*

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

The disclosure is directed to reducing or eliminating changes in latching effects over injector run times, which may cause undesirable delays in start of injection (SOI). This may be accomplished by optimizing geometry of at least one contact surface of a spool and the solenoid coil assemblies. Particularly, one or more contact surfaces of the spool and the solenoid coil assemblies may be modified to minimize a surface area therebetween. Alternatively, contact surfaces may have surface patterns of specific shapes, which may also be effective in reducing or eliminating changes in the latching effects.

Figure 1A:
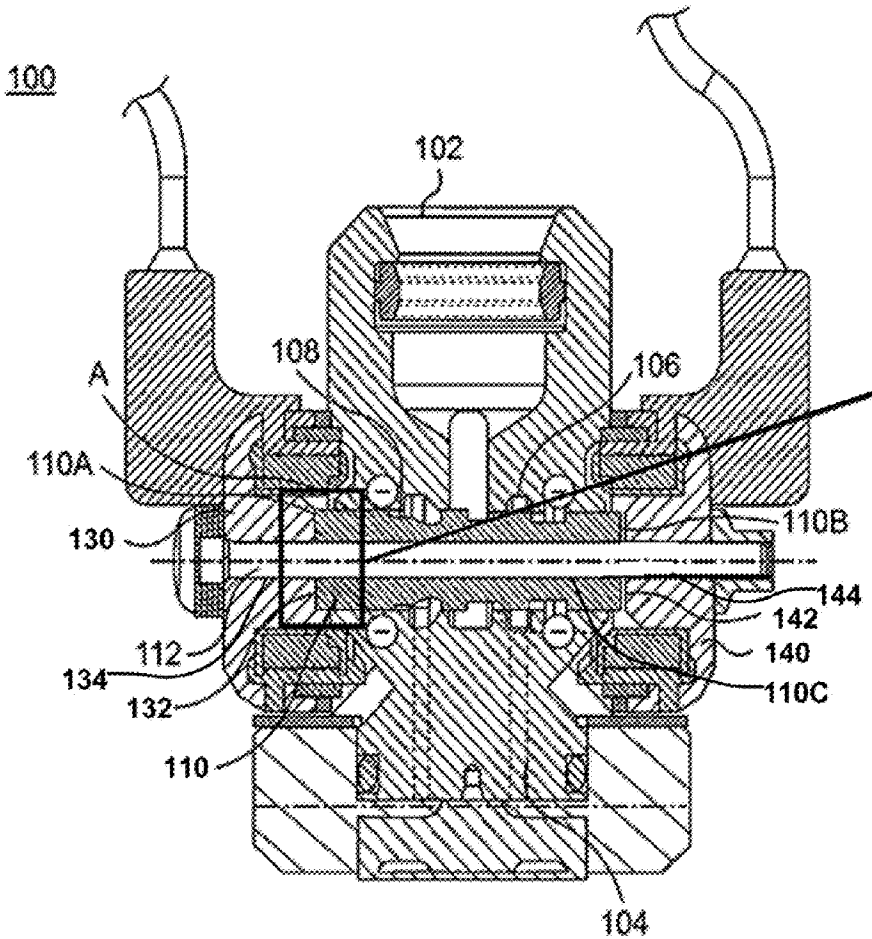
FIG. 1*a* shows a cross sectional view of a control valve body including a pair of solenoid coil assemblies and a spool, constructed according to the principles of the disclosure.

FIG. 1*a* shows a cross sectional view of a control valve body 100, constructed according to the principles of the disclosure. The control valve body 100 may include an inlet area 102, which may be in fluid communication with working ports 104. At least one groove or orifice 106 (hereinafter "grooves") may be positioned between, and in fluid communication with the inlet area 102 and the working ports 104. A spool 110 having at least one groove 108 may be slidably mounted within the control valve body 100. The spool may have a first contact surface 110A and a second contact surface 110B at both ends thereof, respectively. Further, the spool 110 may have a through hole 110C extending from the first contact surface 110A to the second contact surface 110B.

A close coil assembly 130 and an open coil assembly 140 may be positioned on opposing sides of the spool 110, respectively. The close coil assembly 130 may have a contact surface 132 at one side thereof. The first contact surface 110A of the spool 110 may contact the contact surface 132 when the spool 110 moves toward and contacts the close coil assembly 130. The close coil assembly 130 may further have a through hole 134 extending from the contact surface 132 to the opposite side thereof. Similarly, the open coil assembly 140 may have a contact surface 142 at one side thereof. The second contact surface 1106 of the spool 110 may contact the contact surface 142 when the spool 110 moves towards and contacts the open coil assembly 140. The open coil assembly 140 may have a through hole 144 extending from the contact surface 142 to the opposite side thereof. A bolt 112 may be arranged through the through holes 134, 110C, 144 for slidably mounting the spool 110 to the control valve body 100. The through holes 134, 1100, 144 may be concentric and may have the same diameter.

In order to reduce or eliminate changes in the latching effects over injector run times, at least one of the contact surfaces 110A, 110B, 132, 142 of the spool 110 and the coil assemblies 130, 140 may be modified to minimize surface areas. For example, as shown in an exemplary variation in FIG. 1*b*, which shows an enlarged view of box A shown in FIG. 1*a*, the first contact surface 110A of the spool 110 may be modified to form a surface pattern 120 thereon. The surface pattern 120 may include a raised portion 120A and a recessed portion 1206. Only the raised portion 120A may contact the contact surface 132 to minimize the surface area therebetween. This raised portion 120A may contribute to a non-contact area (e.g., a gap) between the spool 110 and the respective contact surfaces 132, 142. In one embodiment, for example, this gap may be approximately 30 μm.

By providing a minimized contact area, the change in the latching effect can be minimized or eliminated by reducing, for example, an oil film between the spool 110 and the contact surfaces 132, 142, itself, or a vacuum or a magnetic adhesion. This may be particularly useful, but not limited, to the open coil assembly 140. Alternatively, both of the facing surfaces, such as, e.g., the first contact surfaces 110A of the spool 110 and the contact surface 132 of the close coil assembly 130, may be modified to minimize the surface area therebetween. This minimized surface area may assist in the drainage of oil between the contact surfaces 110A, 110B, 132, 142, thereby preventing an oil film from forming therebetween. The surface pattern 120 may have a roughened surface (i.e., surface optimization/minimization at the microscopic scale) because quality and structure of the contact and non-contact surfaces may have a significant influence on the fuel decay.

Figure 2:
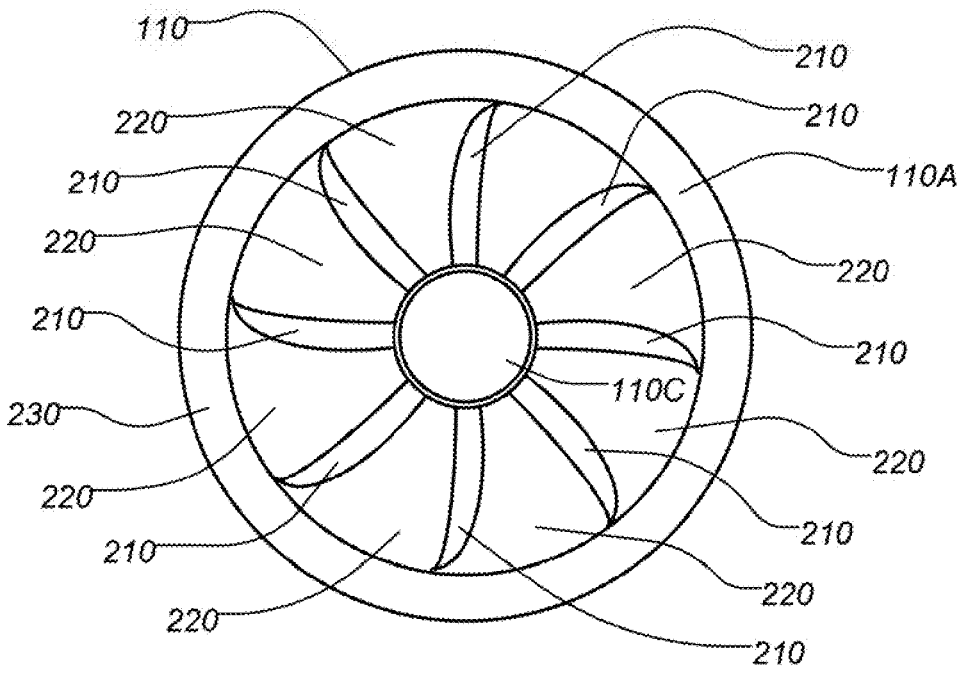
FIG. 2 shows a top view of an exemplary contact surface of the spool shown in FIG. 1*a*, constructed according to the principles of the invention.

FIGS. 2, 3, 4*a*, 4*b*, 5*a*, 5*b*, 6*a*, 6*b*, 6*c*, 6*d*, 7*a* and 7*b* show various exemplary surface patterns for minimizing the surface areas. FIG. 2 exemplarily shows a top view of the first contact surface 110A of the spool 110, in which the first contact surface 110A is modified to form a graphical surface pattern, such as, e.g., a cross hatch pattern, a star pattern, a helical pattern or the like. The surface pattern may be formed by, for example, etching, milling and/or the like. The graphic surface pattern may include raised portions 210, 230 and recessed portions 220. The raised portion 230 may be formed along an outer circumference of the first contact surface 110A. The raised portions 210 may extend from the raised portion 230 to an inner circumference of the first contact surface 110A surrounding the through hole 110C.

Figure 3:
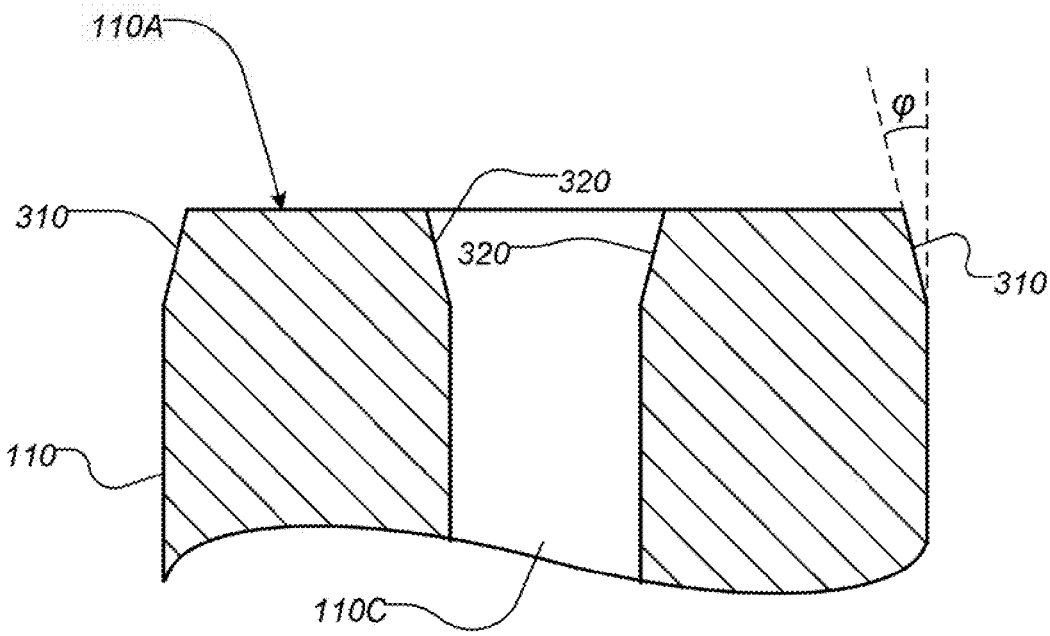
FIG. 3 shows a cross sectional view of another contact surface of the spool shown in FIG. 1*a*, constructed according to the principles of the disclosure.

FIG. 3 shows a cross sectional view of the first contact surface 110A of the spool 110, in which the first contact surfaces 110A is modified to form a turned angle geometry. The turned angle geometry may be in the form of a chamfered edge, which may be formed at an outer circumference 310 and/or an inner circumference 320 of the first contact surface 110A. The chamfered edge angle $\phi$ may be about 4° with ±0.05° deviation; however, the chamfered edge angle $\phi$ may vary with any application of the disclosure. The outer and inner edges 310 and 320 may be chamfered by grinding, turning or the like. In embodiments, the chamfered edge may be formed using either a grinding or turning method, which may provide a rough surface on the non-contact area. This, again, may assist in reducing, preventing or eliminating the change in the latching effects.

Figure 4A:
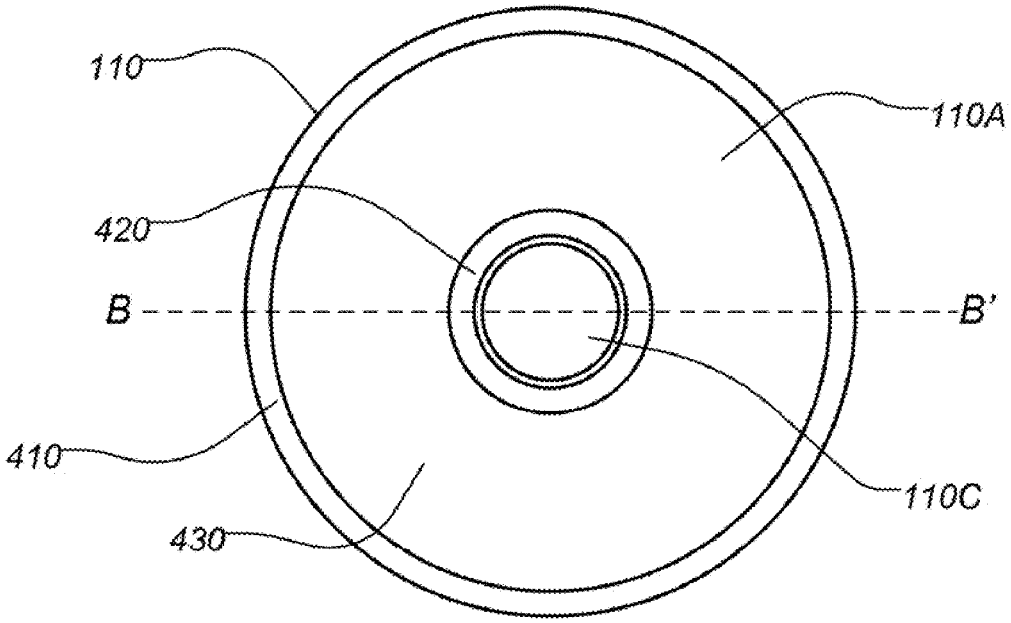
FIG. 4*a* shows a top view of another contact surface of the spool shown in FIG. 1*a*, constructed according to the principles of the disclosure.
Figure 4B:
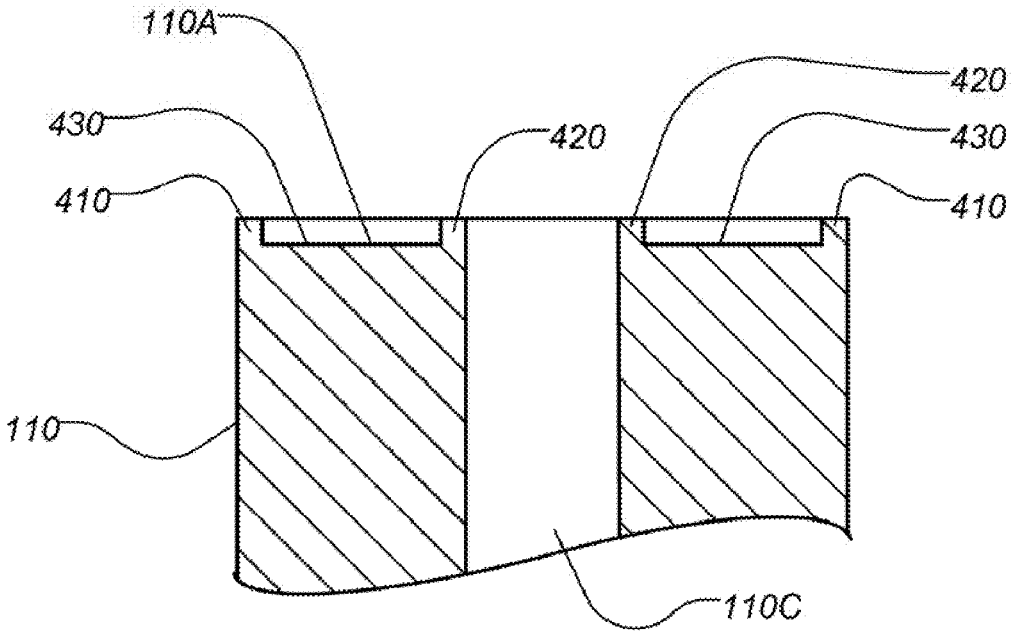
FIG. 4*b* shows a cross sectional view of the contact surface shown in FIG. 4*a*, along line B to B'.

FIG. 4*a* shows a top view of the first contact surface 110A of the spool 110, and FIG. 4*b* shows a cross sectional view of the first contact surface 110A of the spool 110 shown in FIG. 4*a*, along line B to B'. Referring to FIGS. 4*a* and 4*b*, the first contact surface 110A may include raised portions 410, 420 and a recessed portion 430. The raised portion (e.g., an outer ring) 410 may have a circular shape formed along the outer circumference of the contact surface 110A. The second raised portion (e.g., an inner ring) 420 may also have a circular shape formed along the inner circumference of the contact surface 110A surrounding the through hole 110C. The recessed portion 430 may occupy the entire area of the first contact surface 110A except for the raised portions 410, 420. Additionally, the first and second raised portions 410, 420 may not be continuously raised; that is, the first and second raised portions 410, 420 may be non-continuous (e.g., a stepped pattern or other disjointed pattern). This may be applicable for all embodiments in the disclosure.

Still referring to FIGS. 4*a* and 4*b*, those of ordinary skill in the art may understand that hydraulic adhesion may be dependent on the ratio of the surface area versus boundary line of the surface. The hydraulic adhesion may, in turn, contribute to the latching effect. Thus, by providing the outer and inner rings 410, 420 on a contact surface, a ratio at a given geometry is minimized thus reducing, preventing or eliminating the change in the latching effect. That is, the hydraulic adhesion or vacuum effect is minimized due to a minimized surface area between the outer and inner rings 410, 420 and other contact surface. As discussed with reference to other embodiments, the ratio may vary depending on the application of use. This may also be applicable for all embodiments in this disclosure.

Figure 5A:
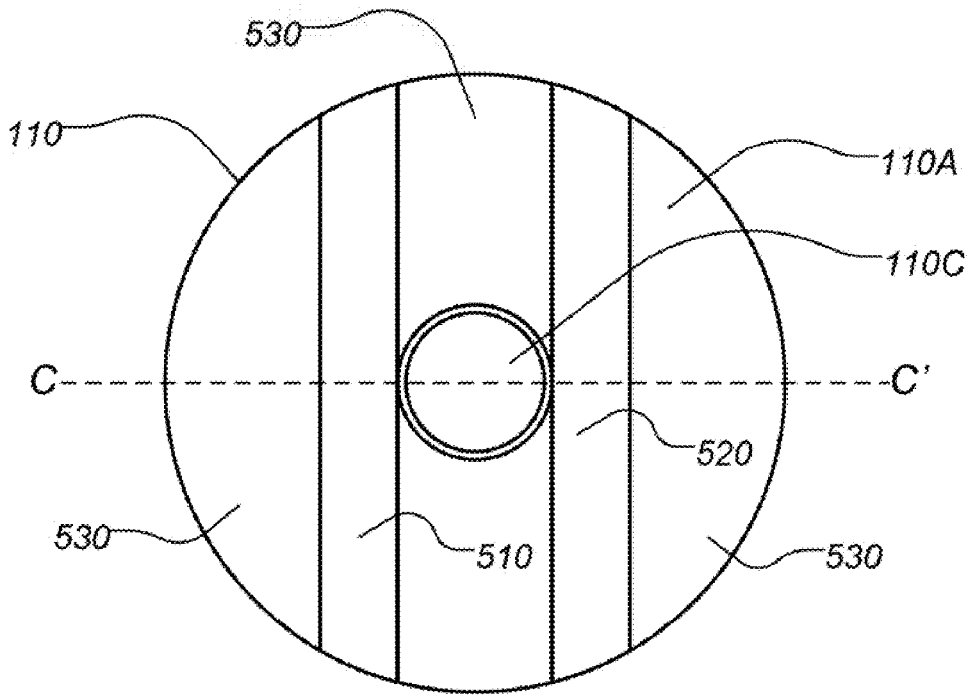
FIG. 5*a* shows a top view of another contact surface of the spool shown in FIG. 1*a*, constructed according to the principles of the disclosure.
Figure 5B:
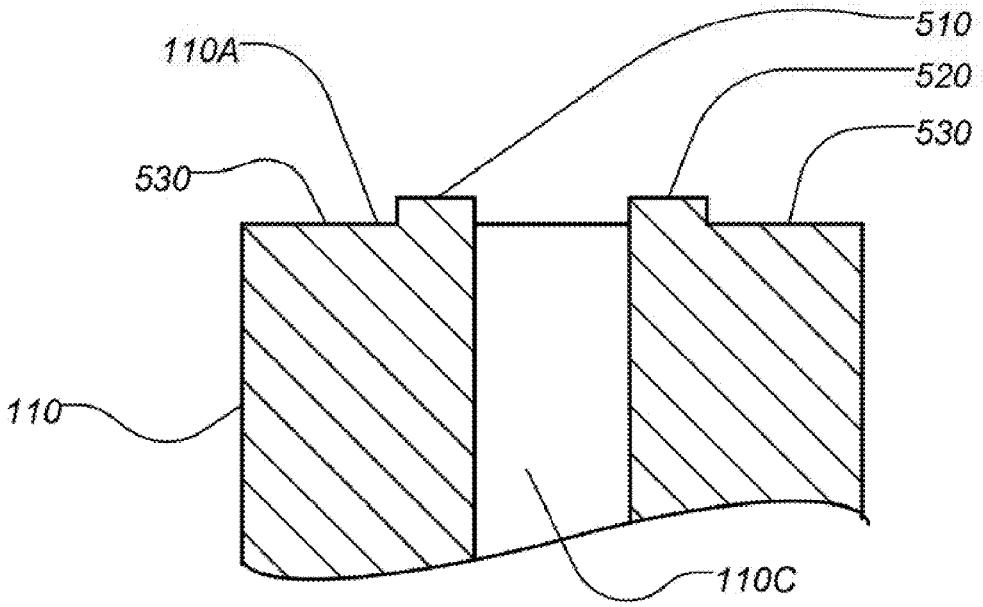
FIG. 5*b* shows a cross sectional view of the contact surface of the spool shown in FIG. 5*a*, along line C to C'.

FIG. 5*a* shows a top view of the first contact surface 110A of the spool 110, and FIG. 5*b* shows a cross sectional view of the first contact surface 110A of the spool shown in FIG. 5*a*, along line C to C'. In FIGS. 5*a* and 5*b*, the first contact surface 110A may include raised portions 510, 520 and recessed portions 530. The raised portions 510, 520 may extend substantially across the first contact surface 110A on both sides of the through hole 110C. Also, the raised portions 510, 520 may extend substantially straight and parallel to each other. Alternatively, the configuration of FIGS. 5*a* and 5*b* may be inverted such that the raised portions 510 may be recessed and the recessed portion 520 may be raised.

Still referring to FIGS. 5*a* and 5*b*, each of the raised portions 510, 520 may have a width of, e.g., approximately 1.2000 mm, thus providing a minimized ratio of the surface area versus boundary line of the surface (much like that of the embodiment of FIGS. 4*a* and 4*b*). This width or surface area ratio, of course, may vary depending on the specific application of the injector. For example, a diesel fuel injector may have a larger width or surface area ratio than a gasoline fuel injector due to the size of the injector required for the engine. It should further be understood that approximately the same ratio as that of the embodiment of FIGS. 4*a* and 4*b* is contemplated by the present invention, but may vary accordingly. Additionally, the wear on the contact area of the embodiment of FIGS. 5*a* and 5*b* may be minimized due the rotation of the spool 110; that is, the rotation of the spool 100 may minimize the contact between any one area or point between the spool 110 and either of the coil assemblies 130, 140. It should now be understood that eliminating or reducing wear on the surfaces may equate to no change in the magnetic or hydraulic latching due to the fact that the gap between the surfaces and the quality of the surfaces may not change over time. This reduced wear may positively influence the fuel decay.

Figure 6A:
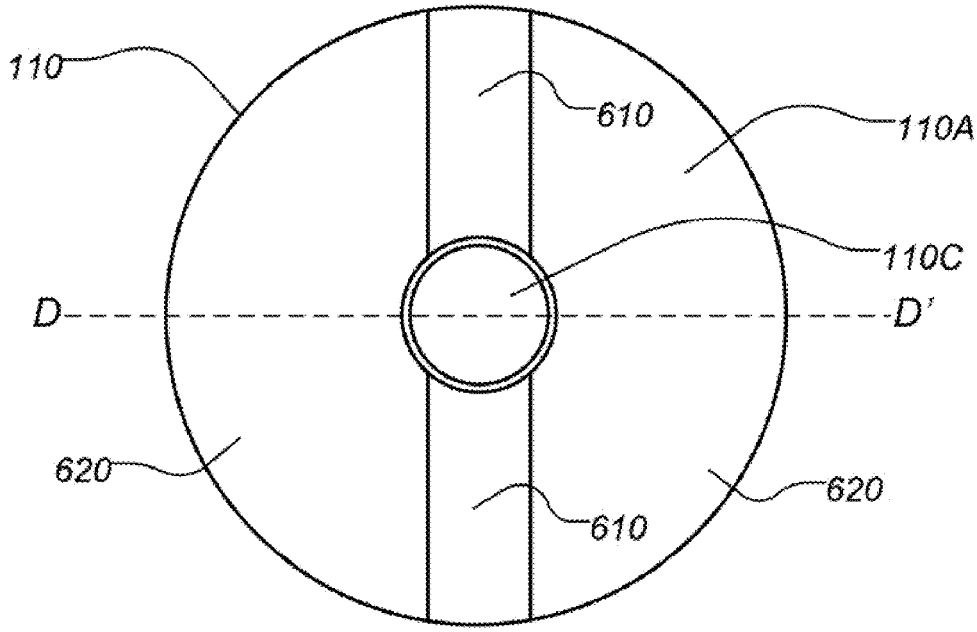
FIG. 6*a* shows a top view of another contact surface of the spool in FIG. 1*a*, constructed according to the principles of the disclosure.
Figure 6B:
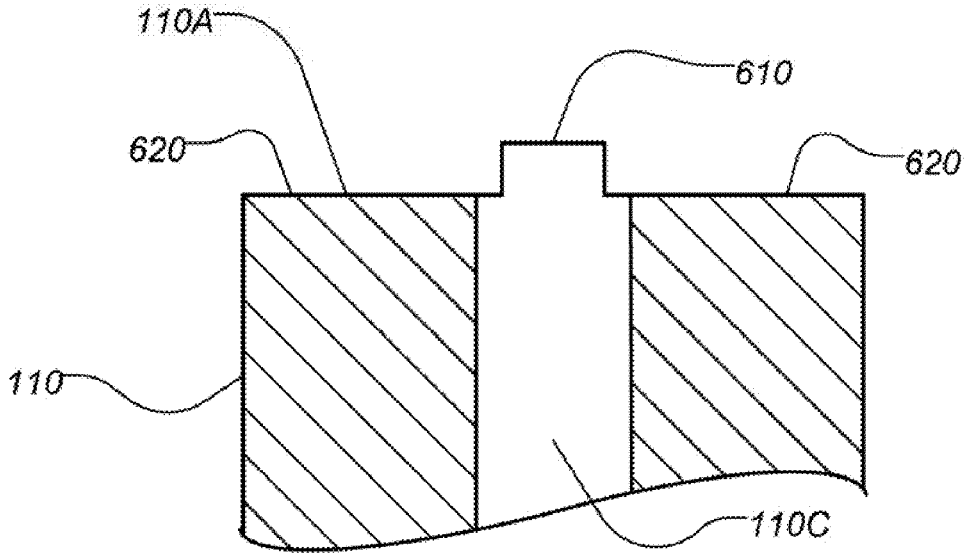
FIG. 6*b* shows a cross sectional view of the contact surface of the spool shown in FIG. 6*a*, along line D to D'.

FIG. 6*a* shows a top view of the first contact surface 110A of the spool 110. FIG. 6*b* shows a cross-sectional view of the contact surface 110A of the spool 110 shown in FIG. 6*a*, along line D to D'. Referring to FIGS. 6*a* and 6*b* collectively, the contact surface 110A may have a surface pattern including a raised portion 610 and a recessed portion 620. The raised portion 610 may longitudinally extend substantially along a diameter of the contact surface 110A except for the through hole 110C, thereby dividing the recessed portion 620 into two halves. An area of the recessed portion 620 may be larger than that of the raised portion 610. The raised portion 610 may include a pair of raised portions arranged on opposite sides of the through hole 110C. The raised portion 610 may be narrower than a diameter of the through hole 110C. The recessed portion 620 may be substantially flat and/or substantially symmetric with respect to the raised portion 610.

Similar to previous embodiments, the ratio of the surface area versus boundary line of the surface may be minimized. The surface area of the raised portion 610 may be equal to the surface area of the raised portions 510, 520 of FIGS. 5*a* and 5*b*. This surface area, of course, may also vary depending on the specific application of the injector. Additionally, the wear on the contact area of the embodiment of FIGS. 6*a* and 6*b* may also be minimized due the rotation of the spool 100. This reduced wear may positively influence the fuel decay.

Figure 6C:
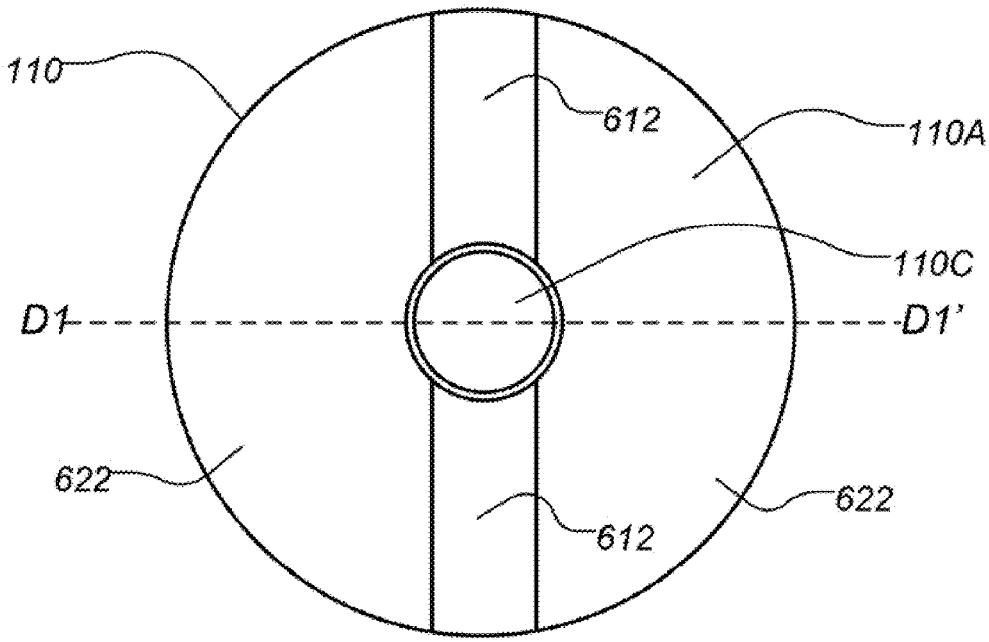
FIG. 6*c* shows a top view of another contact surface of the spool in FIG. 1*a*, constructed according to the principles of the disclosure.
Figure 6D:
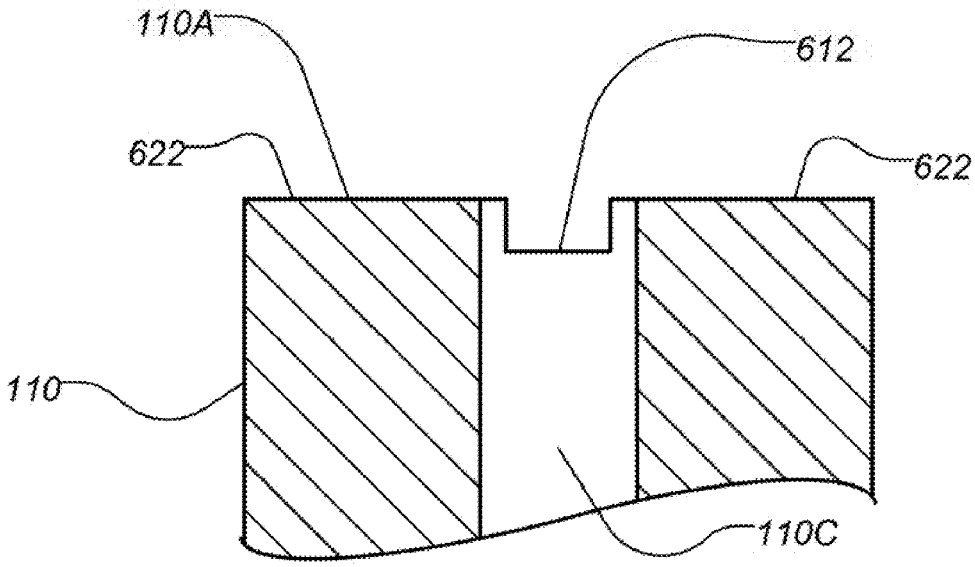
FIG. 6*d* show a cross sectional view of the contact surface of the spool shown in FIG. 6*c*, along line D1 to D1'.

The configuration of FIGS. 6*a* and 6*b* may be inverted such that the raised portion 610 is recessed and the recessed portion 620 is raised. For example, FIG. 6*c* shows another top view of the first contact surface 110A of the spool 110. FIG. 6*d* shows a cross-sectional view of the contact surface 110A of the spool 110 shown in FIG. 6*a*, along line D1 to D1'. Referring to FIGS. 6*c* and 6*d* collectively, the contact surface 110A of the spool 110 may have a surface structure including a recessed portion 612 and a raised portion 622. The recessed portion 612 may longitudinally extend substantially along a diameter of the contact surface 110A except for the through hole 110C, thereby dividing the raised portion 622 into two halves. An area of the raised portion 622 may be larger than that of the recessed portion 612. The recessed portion 612 may include a pair of recessed portions arranged on opposite sides of the through hole 110C. The recessed portion 612 may be narrower than a diameter of the through hole 110C. The raised portion 622 may be substantially flat and/or substantially symmetric with respect to the recessed portion 612.

Figure 7A:
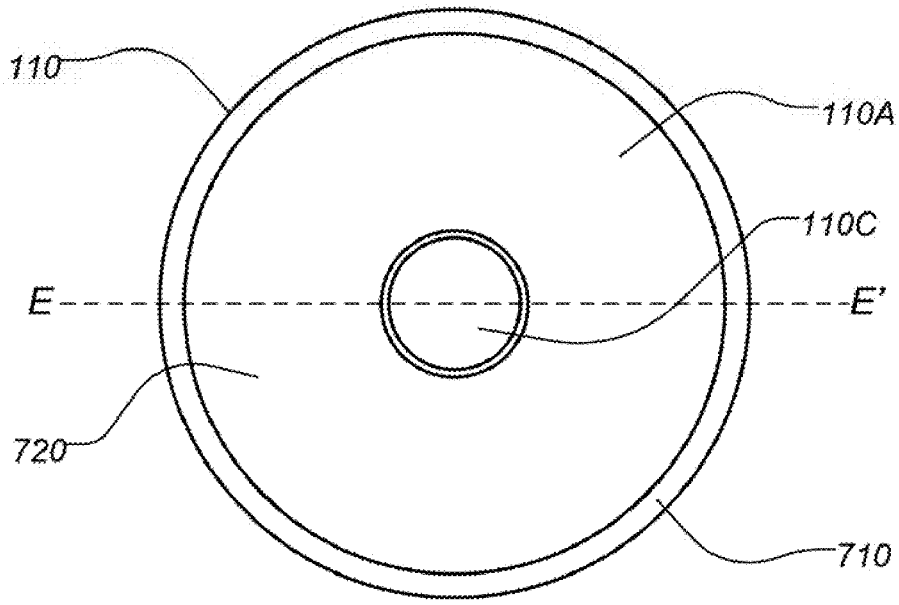
FIG. 7*a* shows a top view of another contact surface of the spool shown in FIG. 1*a*, constructed according to the principles of the disclosure.
Figure 7B:
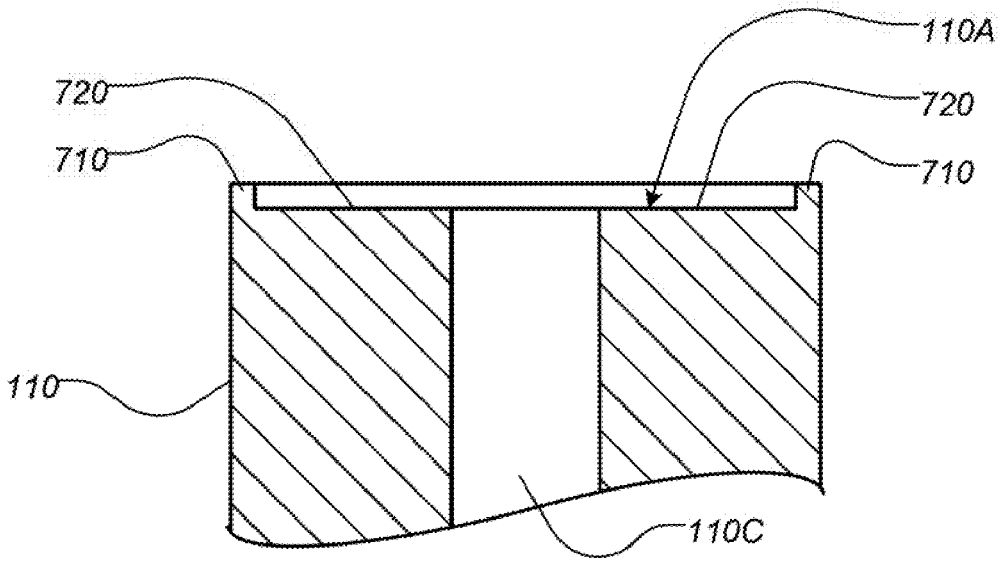
FIG. 7*b* shows a cross sectional view of the contact surface shown of spool shown in FIG. 7*a*, along line E to E'.

FIG. 7*a* shows a top view of the first contact surface 110A of the spool 110, and FIG. 7*b* shows a cross sectional view of FIG. 7*a* along line E to E'. Referring to FIGS. 7*a* and 7*b*, the first contact surfaces 110A may have a raised portion 710 and a recessed portion 720. The raised portion 710 may have a circular shape, which may be formed along an outer circumference of the contact surface 110A. Other areas of the first contact surface 110A may be occupied by the recessed portion 720. The raised portion 710 may be referred to as "lips" or "an outer ring". In one exemplary illustration, the outer ring 710 may have an inside diameter of, e.g., about 6.4 mm and an outer diameter of, e.g., about 7.0 mm.

It should be understood by one of ordinary skill in the art that the magnetic forces may be typically higher at the outside edges of the spool 110. This may result in a higher "pulling" force of the spool 110. By moving the raised portion 710 to only the outer portion, the surface contact area may be increased, compared to only on the inner-more portion. This may result in a greater pulling force, while maintaining the required minimum ratio of the surface area versus boundary line of the surface. An increased surface area at only the inner portion (without any other structures as described herein) may result in a same pulling force but may result in the unintended hydraulic latching effects.

The foregoing surface patterns may be applied to and be representative of any combination of the contact surfaces 110A, 110B of the spool 110. Additionally, the geometries may be applied to and be representative of any combination of the contact surfaces 132, 142 of the coil assemblies 130, 140, respectively, and the contact surfaces 110A and 1106 of the spool 110. It is also contemplated by the present invention that the foregoing surface patterns may be applied to both of the contact surfaces 132, 142 of the coil assemblies 130, 140 and the contact surfaces 110A and 1106 of the spool 110, or any combination thereof. In aspects of the disclosure, a 6.5 $mm^2$ surface area vs. 7.6 mm boundary line is contemplated by the disclosure resulting in a ratio of about 0.85. In the two ring structure of FIGS. 4*a* and 4*b*, the split ring ratio may be approximately 0.3. In the structure of FIG. 7*a*, the outside ring has a ratio of about 0.5. The optimal range, for any of the aspects of the present invention, may be between 0.2 and 0.5. Other ratios are also contemplated by the disclosure. The surface of the spool 110 or the coil assemblies 130, 140 may also include a coating (e.g., diamond like coating (DLC), tungsten carbide/carbon (WC/C), hard chrome and the like). This may improve the wear resistance and thus the robustness. Additional increased hardness and more wear resistant material may also be provided in accordance with the disclosure.

Figure 8A:
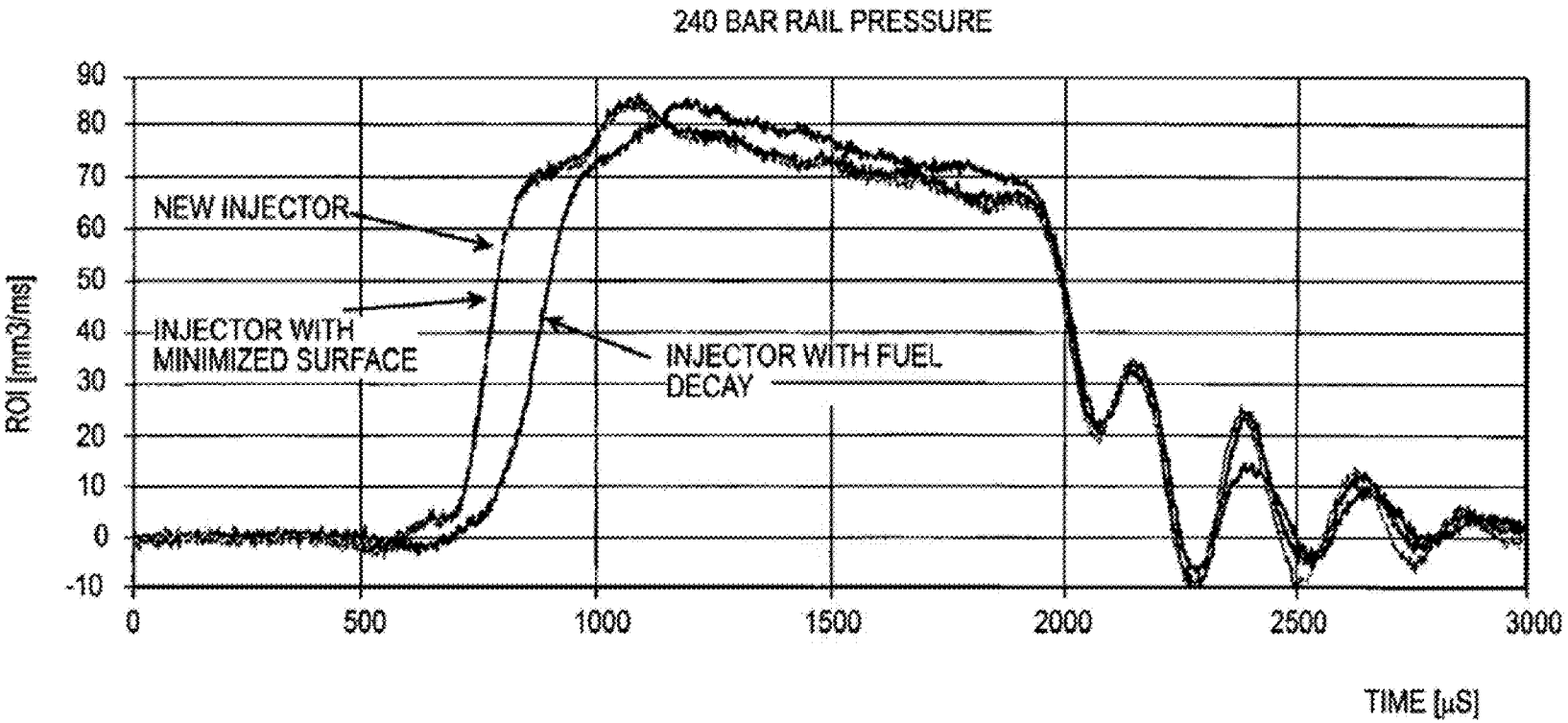
FIGS. 8*a* and 8*b* show graphs illustrating performance examples, according to the principles of the disclosure.
Figure 8B:
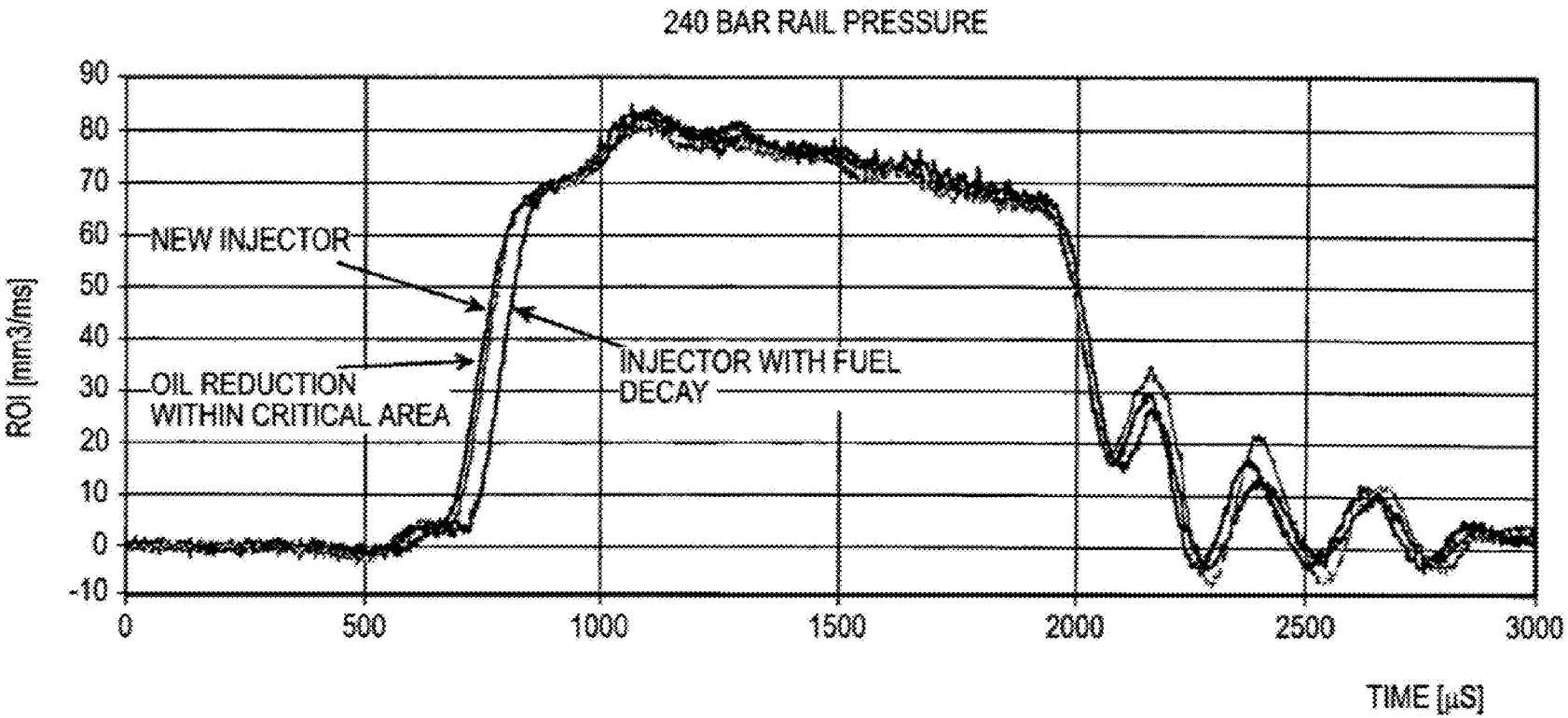

FIGS. 8*a* and 8*b* show graphs displaying performance of a new injector, an injector with a minimized surface and an injector with fuel decay. Particularly, FIGS. 8*a* and 8*b* graph rate of injection (ROI) versus time at a rail pressure of 240 bars. The graph of FIG. 8*b* shows oil reduction in critical areas of the fuel injector of the disclosure being substantially the same as that of a new fuel injector. The injector according to the disclosure has a substantially superior performance over time; whereas, a known injector over time (used injector) shows decreased performance or fuel decay. The fuel decay injectors (e.g., defective injectors) can be restored by applying the minimized surface areas as discussed throughout. After restoration, the reoccurrence of decay is substantially minimized or eliminated.

Referring back to FIGS. 1*a* and 1*b*, the surface pattern 120 may be formed on at least one of the contact surfaces 110A, 1106, 132 and 142 of the spool 110 and the first and second coil assemblies 130 and 140. FIGS. 9*a*, 9*b*, 9*c*, 9*d*, 9*e*, 9*f*, 9*g*, 9*h*, 9*i*, 9*j*, 9*k*, 9*l*, 9*m*, 9*n* and 9*o* symbolically show the surface pattern 120 formed on at least one of the contact surfaces 110A, 1106, 132 and 142 of the spool 110 and the first and second coil assemblies 130 and 140 shown in FIG. 1*a*.

Figure 9A:
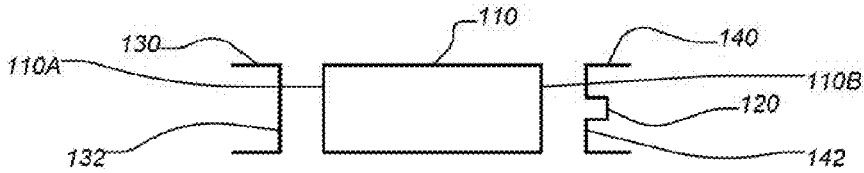
FIGS. 9*a*, 9*b*, 9*c*, 9*d*, 9*e*, 9*f*, 9*g*, 9*h*, 9*i*, 9*j*, 9*k*, 9*l*, 9*m*, 9*n* and 9*o* symbolically show one or more surface patterns formed on at least one of the contact surfaces of the spool and coil assemblies shown in FIG. 1*a;*
Figure 9B:
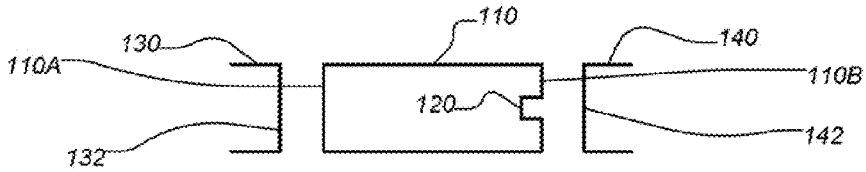
Figure 9C:
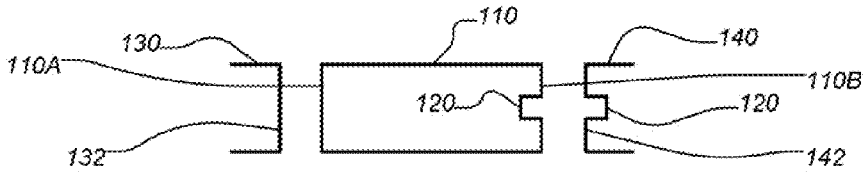
Figure 9D:
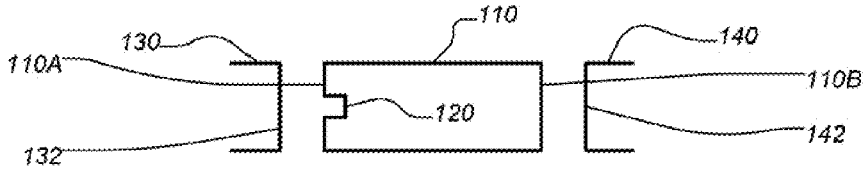
Figure 9E:
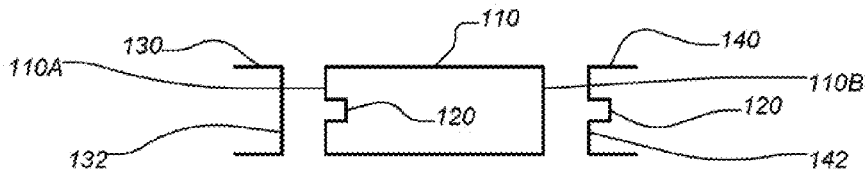
Figure 9F:
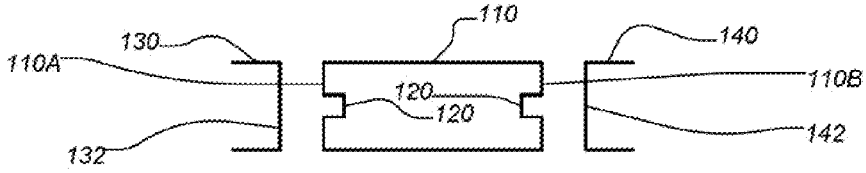
Figure 9G:
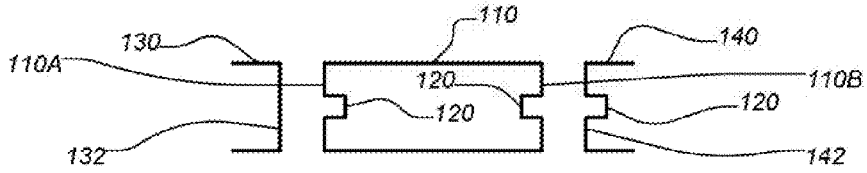
Figure 9H:
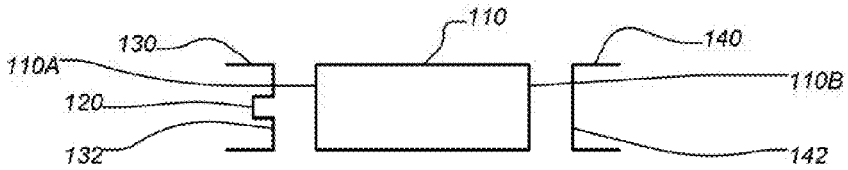
Figure 9I:
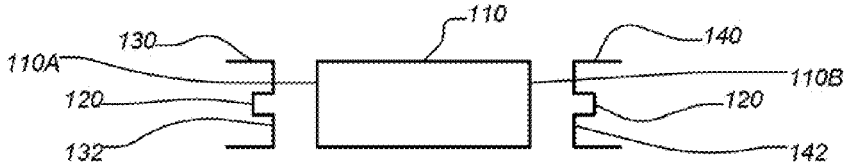
Figure 9J:
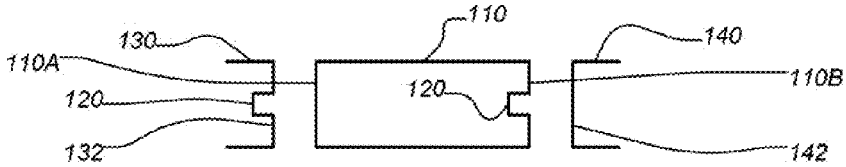
Figure 9K:
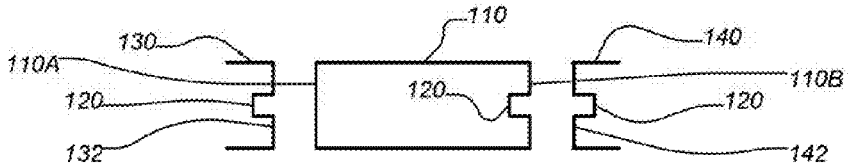
Figure 9L:
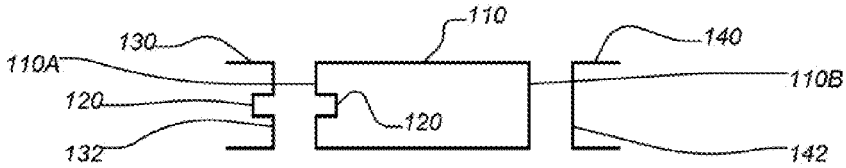
Figure 9M:
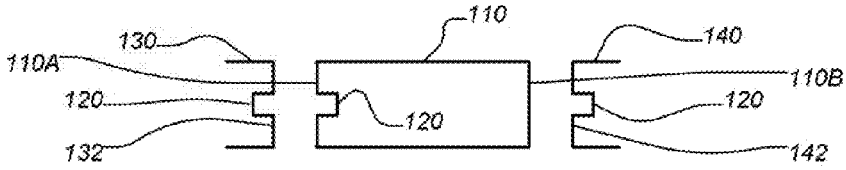
Figure 9N:
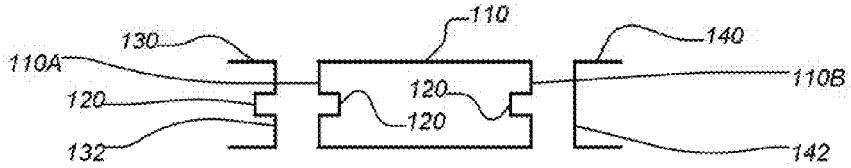
Figure 9O:
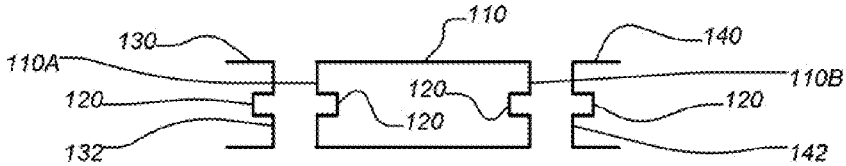

Particularly, FIG. 9*a* shows the surface pattern 120 formed at the solenoid contact surface 142 of the coil assembly 140. FIG. 9*b* shows the surface pattern 120 formed at the contact surface 110B of the spool 110. FIG. 9*c* shows the surface pattern 120 formed at the contact surface 1106 of the spool 110 and the solenoid contact surface 142 of the coil assembly 140. FIG. 9*d* shows the surface pattern 120 formed at the contact surface 110A of the spool 110. FIG. 9*e* shows the surface pattern 120 formed at the contact surface 110A of the spool 110 and the solenoid contact surface 142 of the coil assembly 140. FIG. 9*f* shows the surface pattern 120 formed at the contact surfaces 110A, 110B of the spool 110. FIG. 9*g* shows the surface pattern 120 formed the contact surfaces 110A, 110B of the spool 110 and the solenoid contact surface 142 of the coil assembly 140. FIG. 9*h* shows the surface pattern 120 formed at the solenoid contact surface 132 of the coil assembly 130. FIG. 9*i* shows the surface pattern 120 formed at the solenoid contact surface 132 of the coil assembly 130 and the solenoid contact surface 142 of the coil assembly 140. FIG. 9*j* shows the surface pattern 120 formed at the solenoid contact surface 132 of the coil assembly 130 and the contact surface 110B of the spool 110. FIG. 9*k* shows the surface pattern 120 formed at the solenoid contact surface 132 of the coil assembly 130, the contact surface 110B of the spool 110 and the solenoid contact surface 142 of the coil assembly 140. FIG. 9*l* shows the surface pattern 120 formed at the solenoid contact surface 132 of the coil assembly 130 and the contact surface 110A of the spool 110. FIG. 9*m* shows the surface pattern 120 formed at the solenoid contact surface 132 of the coil assembly 130, the contact surface 110A of the spool 110 and the solenoid contact surface 142 of the coil assembly 140. FIG. 9*n* shows the surface pattern 120 formed at the solenoid contact surface 132 of the coil assembly 130, the contact surface 110A of the spool 110 and the contact surface 110B of the spool 110. FIG. 9*o* shows the surface pattern 120 formed at the solenoid contact surface 132 of the coil assembly 130, the contact surface 110A of the spool 110, the contact surface 110B of the spool 110 and the solenoid contact surface 142 of the coil assembly 140. Accordingly, the surface pattern 120 may be applied to any combination of the contact surfaces 132, 142, 110A and 1108.

While the contact surfaces may be modified to minimize the surface areas in the embodiments shown in FIGS. 2, 3, 4*a*, 4*b*, 5*a*, 5*b*, 6*a*, 6*b*, 6*c*, 6*d*, 7*a* and 7*b*, contact surfaces having surface patterns of specific shapes may be also effective in reducing or eliminating changes in the latching effects. The contact surface patterns of the disclosure may be implemented without minimizing the surface areas.

Figure 10A:
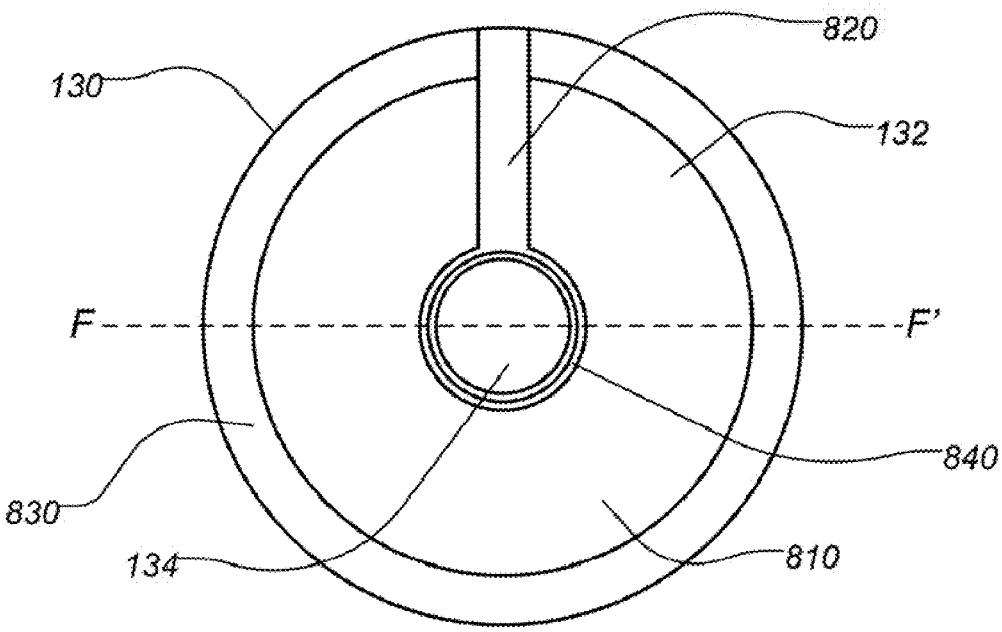
FIG. 10*a* shows a top view of a contact surface of the coil assembly shown in FIG. 1*a*, constructed according to the principles of the disclosure.
Figure 10B:
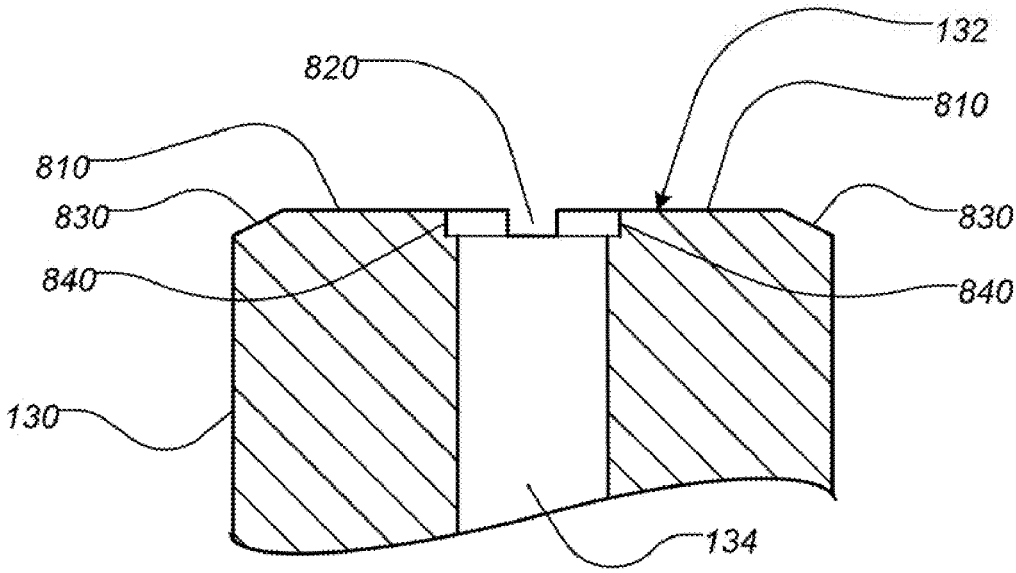
FIG. 10*b* shows a cross sectional view of the contact surface of the coil assembly shown in FIG. 10*a*, along line F to F'.

FIG. 10*a* shows a top view of the contact surface 132 of the close coil assembly 130 shown in FIG. 1*a*, constructed according to an embodiment of the disclosure. FIG. 10*b* shows a cross sectional view of the contact surface 132 of the close coil assembly 130 shown in FIG. 10*a*, along line F to F'. The contact surface 132 may be modified to form a surface pattern including a raised portion 810 and a single recessed portion 820. The recessed portion 820 may extend substantially straight in a substantially radial direction of the contact surface 132. For example, the recessed portion 820 may extend from an inner circumference of the contact surface 132 surrounding the through hole 134 to an outer circumference of the contact surface 132. The raised portion 810 may occupy the entire area of the contact surface 132 except for the single recessed portion 820. Alternatively (or additionally), the surface pattern of the contact surface 132 may further include a recessed portion 830 and/or a recessed portion 840. The recessed portion 830 may be formed along the outer circumference of the contact surface 132. The recessed portion 830 may be chamfered as shown in FIG. 10*b*. The recessed portion 840 may be formed along an inner circumference of the contact surface 132 surrounding the through hole 134. Both of the recessed portions 830, 840 may have a circular shape. The recessed portion 820 may substantially extend from the recessed portion 840 to the recessed portion 830.

Figure 11A:
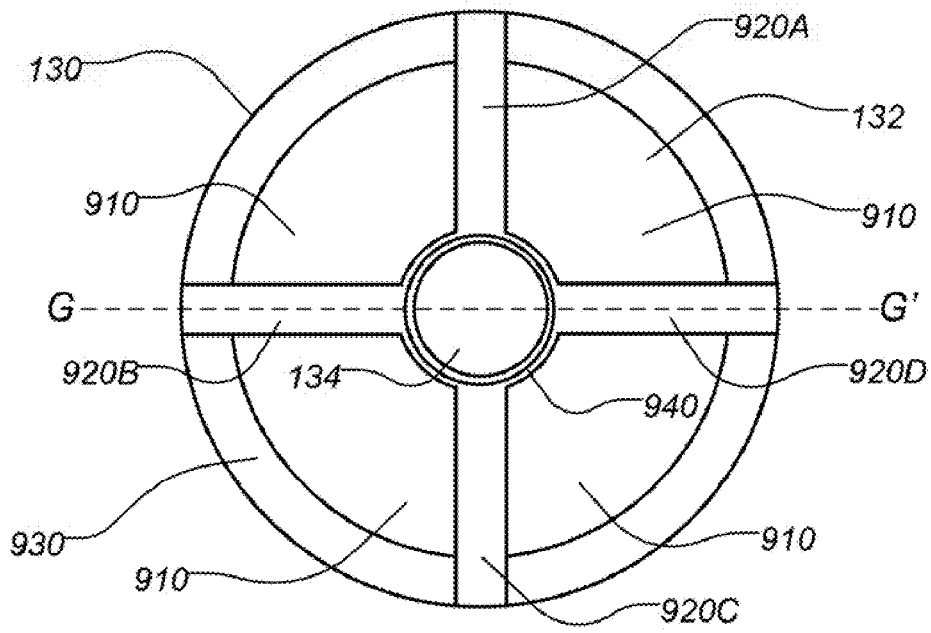
FIG. 11*a* shows a top view of another contact surface of the coil assembly shown in FIG. 1*a*, constructed according to the principles of the disclosure.
Figure 11B:
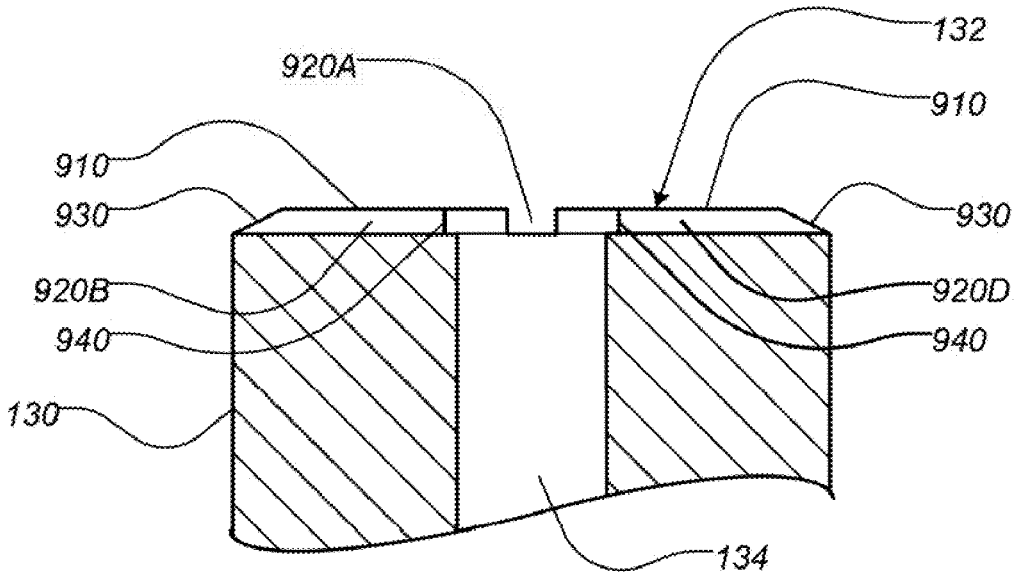
FIG. 11*b* shows a cross sectional view of the contact surface configuration of the coil assembly shown in FIG. 11*a*, along line G to G'.

FIG. 11*a* shows a top view of the contact surface 132 of the close coil assembly 130 shown in FIG. 1*a*, constructed according to another embodiment of the disclosure. FIG. 11*b* shows a cross sectional view of the contact surface 132 of the close coil assembly 130 shown in FIG. 11*a*, along line F to F'. In this embodiment, the contact surface 132 may include four recessed portions 920A, 920B, 920C, 920D and raised portions 910. The recessed portions 920A, 920B, 920C, 920D may extend perpendicular to each other to form a cross shape as shown in FIG. 11*a*. Similar to the recessed portion 820 shown in FIG. 10A, each of the recessed portions 920A, 920B, 920C, 920D may extend from an inner circumference of the contact surface 132 surrounding the through hole 134 to an outer circumference of the contact surface 132. Each of the recessed portions 920A, 920B, 920C, 902D may extend substantially straight in a substantially radial direction of the contact surface 132. The raised portion 910 may occupy the entire area of the contact surface 132 except for the recessed portions 920A, 920B, 920C, 920D. Alternatively, the contact surface 132 may further include at least one of a recessed portion 930 and a recessed portion 940. The recessed portion 930 may be formed along the outer circumference of the contact surface 132. The recessed portion 930 may be chamfered as shown in FIG. 11*b*. The recessed portion 940 may be formed along an inner circumference of the contact surface 132 surrounding the through hole 134. Both of the recessed portions 930, 940 may have a circular shape. Each of the recessed portions 920A, 920B, 920C, 902D may substantially extend from the recessed portion 940 to the recessed portion 930.

Alternatively or additionally, the surface pattern may be formed at the spool 110 and/or the open coil assembly 140. The surface patterns may not be formed at both of the contact surfaces facing each other to avoid performance issues, such as, e.g., incorrect stopping of the spool 110, high contact stress and/or the like. Accordingly, the surface pattern may be formed only at one or both of the contact surfaces 110A, 1108 of the spool 110, or, alternatively, formed only at one or both of the contact surfaces 132, 142 of the coil assemblies 130, 140. In a different embodiment, the surface pattern may be formed only at the contact surfaces 110A of the spool 110 and the contact surface 142 of the coil assembly 140. Alternatively, the surface pattern may be formed only at the contact surface 110B of the spool 110 and the contact surface 132 of the coil assembly 130.

A contact surface having the particularly shaped surface patterns shown in FIGS. 8*a*, 8*b*, 9*a* and 9*b* may more effectively reduce or eliminate changes in the latching effects than a contact surface with no surface pattern. Furthermore, the particular surface pattern shown in FIGS. 8*a* and 8*b* may be substantially calibration transparent, which means, when a new coil assembly and/or spool with the surface pattern shown in FIGS. 8*a*, 8*b* is installed in an old injector to replace the existing coil assembly and/or spool thereof, the new coil assembly and/or spool may cause no substantial changes in performance characteristics of the injector. Thus, a coil assembly and/or spool with the surface pattern shown in FIGS. 8*a*, 8*b* may be particularly useful as a replacement part for fuel injectors with aging and inefficient control valves, coil assemblies and/or spools, in addition to the benefit of reducing or eliminating changes in latching effects more effectively. The surface pattern shown in FIGS. 9*a* and 9*b* may be less calibration transparent, and, hence, may be less desirable as a replacement part, even though it may be readily used as a replacement part. Nonetheless, new injectors with the surface pattern shown in FIGS. 9*a* and 9*b* may benefit from reduction or even elimination of changes in the latching effects.

Figure 12:
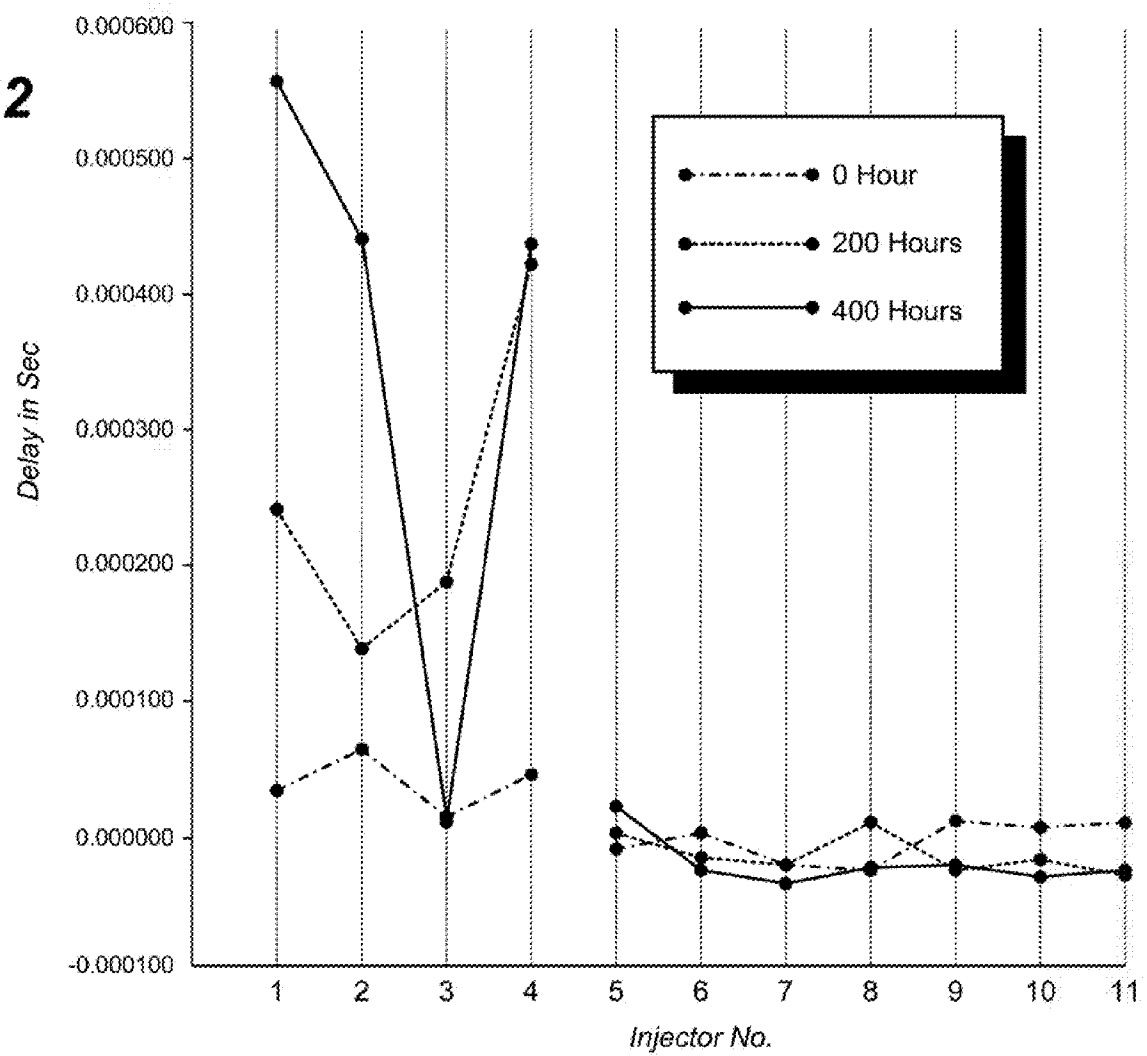
FIG. 12 shows a start of injection (SOI) delay comparison chart illustrating delay times of injectors with no surface pattern and injectors with the cross-shaped recessed portion shown in FIGS. 11*a* and 11*b*.

FIG. 12 shows a start of injection (SOI) delay chart showing delay times of (a) four injectors (i.e., Injector Nos. 1, 2, 3 and 4) having no surface pattern on the contact surface thereof, and (b) seven injectors (i.e., Injector Nos. 5, 6, 7, 8, 9, 10 and 11) having the cross shaped surface pattern shown in FIGS. 11*a* and 11*b*. The delay times are shown on the vertical axis of the chart, have values, e.g., ranging from −0.000100 seconds to 0.000600 seconds. The injectors (e.g., Injector Nos. 1, 2, 3, . . . , 11) are shown on the horizontal axis of the chart.

As shown in FIG. 12, while all the injectors initially show very little SOI delay in at the zero (0) hour point, the Injector Nos. 5, 6, 7, 8, 9, 10 and 11 show significant improvement over the Injector Nos. 1, 2, 3 and 4 at the 200 and 400 hour points. More specifically, while the Injector Nos. 1, 2, 3 and 4 suffer substantially increased SOI delay at the 200 and 400 hour points, the Injector Nos. 5, 6, 7, 8, 9, 10 and 11 show substantially the same SOI delay at the 0, 200 and 400 hour points. Accordingly, the injectors according to the disclosure exhibit substantially superior performances over time with increased fuel injector efficiency.

Figure 13:
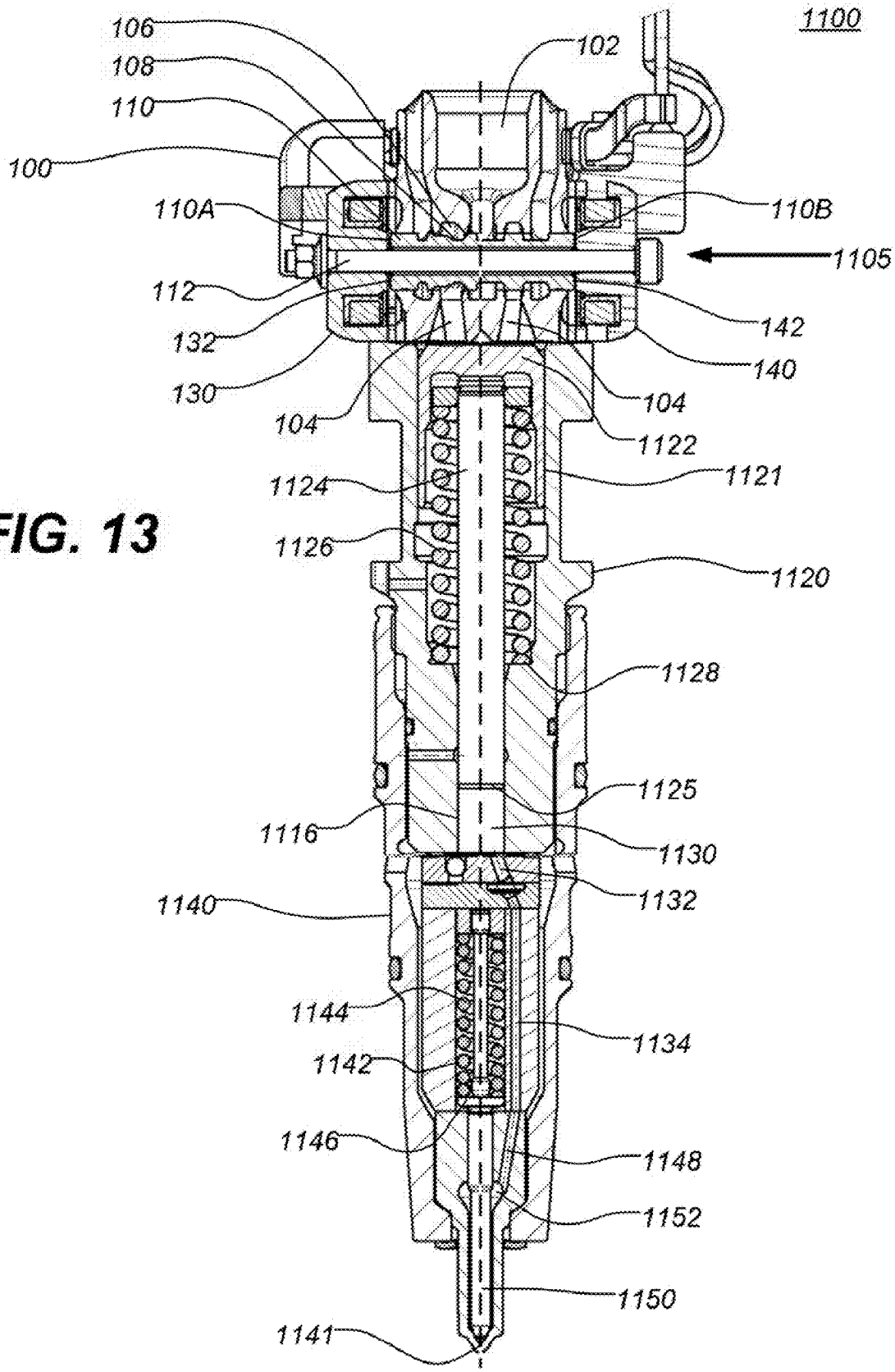
FIG. 13 shows a cross sectional view of a fuel injector including the control valve body shown in FIG. 1*a*, constructed according to the principles of the disclosure.

FIG. 13 shows a cross-sectional view of a fuel injector assembly 1100, which may include either or both of the surface patterns shown in FIGS. 8*a*, 8*b*, 9*a* and 9*b*, constructed according to an embodiment of the disclosure. The main components of the fuel injector assembly 1100 may include, but are not limited to, the control valve body 100 (also shown in FIG. 1*a*), an intensifier body 1120, a nozzle 1140 and/or the like. The intensifier body 1120 may be attached to the control valve body 100 via any conventional mounting mechanism. A piston 1122 may be slidably positioned within an intensifier chamber 1121 of the intensifier body 1120 and may be in contact with an upper end of a plunger 1124. An intensifier spring 1126 may surround a portion (e.g., shaft) of the plunger 1124 and may be further positioned between the piston 1122 and a flange or shoulder 1128 formed on an interior portion of the intensifier body 1120. The intensifier spring 1126 may urge the piston 1122 and the plunger 1124 in a first position proximate to the control valve body 100. A high-pressure chamber 1130 may be formed by an end portion 1125 of the plunger 1124 and an interior wall 1116 of the intensifier body 1120.

The nozzle 1140 may include a fuel inlet 1132 in fluid communication with the high-pressure chamber 1130 and a fuel bore 1134. The fuel bore 1134 may be straight or angled or at other known configuration. This fluid communication may allow fuel to flow from the high-pressure chamber 1130 to the nozzle 1140. A spring cage 1142, which may include a centrally located bore, which may be bored into the nozzle 1140. A spring 1144 and a spring seat 1146 may be positioned within the centrally located bore of the spring cage 1142. The nozzle 1140 may further include a bore 1148 in alignment with the fuel bore 1134. A needle 1150 may be preferably centrally located with the nozzle 1140 and may be urged downwards by the spring 1144. A fuel chamber 1152, such as, e.g., a heart chamber, may surround the needle 1150 and may be in fluid communication with the bore 1148.

In operation, a driver (not shown) may first energize the coil of the open coil assembly 140. The energized coil may then shift the spool 110 to an open position. To reduce or eliminate the SOI delay between the spool 110 and the close coil assembly 130, at least one of the contact surface 110A of the spool 110 and the contact surface 132 of the close coil assembly 130 may have a surface pattern, such as, e.g., the surface pattern shown in FIGS. 10*a* and 10*b* or FIGS. 11*a* and 11*b*, or the like. In the open position, the groove 108 of the spool 110 may overlap with the groove 106. This may provide a fluid path for the working fluid to flow from the inlet port 102 to ambient. In this position, the working fluid pressure within the pressure chamber 1130 may be much lower than the rail inlet pressure. At this pressure stage, the spool 110 may move to seal the venting space. This may allow the working fluid to flow between the inlet port 102 and the intensifier chamber 1121 via the working port 104.

Once the pressurized working fluid is allowed to flow into the working port 106, it may begin to act on the piston 1122 and the plunger 1124. That is, the pressurized working fluid may begin to push the piston 1122 and the plunger 1124 downwards thus compressing the intensifier spring 1126. As the piston 1122 is pushed downward, the fuel in the high-pressure chamber 1130 may begin to be compressed by the end portion 1125 of the plunger 1124. A quantity of compressed fuel may be forced through the bores 1134, 1148 into the fuel chamber 1152 which surrounds the needle 1150. As the pressure increases, the fuel pressure may rise above a needle check valve opening pressure until the needle spring 1144 is urged upwards. At this stage, an injection hole 1141 may open in the nozzle 1140, thus allowing a quantity of fuel to be injected into the combustion chamber of the engine (not shown).

To end the injection cycle, the driver may energize the coil of the closed coil assembly 130. The magnetic force generated in the coil may then shift the spool 110 into the closed position, which, in turn, may offset the groove 108 from the groove 106. As noted earlier, to reduce the SOI delay between the spool 110 and the open coil assembly 140, at least one of the contact surface 1106 of the spool 110 and the contact surface 142 of the open coil assembly 140 may have a surface pattern, such as, e.g., the surface pattern shown in FIGS. 10*a* and 10*b* or FIGS. 11*a* and 11*b*, or the like. At this stage, the pressure may begin to increase in the pressure chamber 1130 and force the spool 110 in the direction of an arrow 1105. This may open a venting space of the spool 110. Also, the inlet port 102 may no longer be in fluid communication with the groove 106 (and the intensifier chamber 1121). The working fluid within the intensifier chamber 1121 may then be vented to ambient and the spring 1144 may urge the needle 1150 downwardly towards the injection hole 1141 of the nozzle 1140, thereby closing the injection hole 1141. Similarly, the intensifier spring 1126 may urge the plunger 1124 and the piston 1122 into the closed or first position adjacent to the control valve body 100. As the plunger 1124 moves upward, fuel may again begin to flow into the high-pressure chamber 1130 of the intensifier body 1120.

While the disclosure has been described in terms of exemplary embodiments, those skilled in the art will recognize that the disclosure can be practiced with modifications in the spirit and scope of the appended claims. These examples given above are merely illustrative and are not meant to be an exhaustive list of all possible designs, embodiments, applications or modifications of the disclosure.

What is claimed is:

1. A control valve, comprising:

a main body;

a first coil assembly arranged on a first side of the main body and comprising a first contact surface and a first through hole extending from the first contact surface; a second coil assembly arranged on a second side of the main body and comprising a second contact surface and a second through hole extending from the second contact surface;

a spool arranged within the main body and configured to move between the first and the second contact surfaces, the spool comprising:

a third contact surface facing the first contact surface;

a fourth contact surface facing the second contact surface; and a third through hole extending from the third contact surface to the fourth contact surface; and a surface pattern formed on one or more of the first, second, third and fourth contact surfaces and comprising a first recessed portion having in a cross shape.

2. The control valve of claim 1, wherein the first recessed portion comprises four recessed portions arranged in the cross shape, each of the recessed portions of the first recessed portion substantially extending from an inner circumference to an outer circumference of the corresponding one of the first, second, third and fourth contact surfaces.

3. The control valve of claim 2, wherein each of the recessed portions of the first recessed portion is substantially straight.

4. The control valve of claim 3, wherein each of the recessed portions of the first recessed portion extends in a substantially radial direction of the corresponding contact surface.

5. The control valve of claim 2, wherein the surface pattern further comprises a second recessed portion formed substantially along an outer circumference of the corresponding contact surface.

6. The control valve of claim 5, the second recessed portion comprises a chamfered edge.

7. The control valve of claim 5, wherein the surface pattern further comprises a third recessed portion formed substantially along an inner circumference of the corresponding contact surface.

8. The control valve of claim 7, wherein each of the recessed portions of the first recessed portion substantially extends between the second recessed portion and the third recessed portion.

9. A fuel injector comprising the control valve of claim 1.

10. A control valve, comprising:

a control body;

a first coil assembly positioned at a first side of the control body and having a first surface;

a second coil assembly positioned at a second side of the control body and having a second surface; and a spool positioned within the control body and configured to move between the first and second surfaces, the spool comprising a third surface facing the first surface, a fourth surface facing the second surface and a through hole extending from the third surface to the fourth surface, wherein at least one of the first, second, third and fourth surfaces has a surface configuration comprising a main surface portion and a slot longitudinally extending over an entire diameter thereof of the surface configuration except for the through hole, thereby dividing the main surface portion into two halves, wherein the slot is formed on at least one of the third and fourth surfaces of the spool.

11. The control valve of claim 10, wherein the main surface portion comprises a contact surface.

12. The control valve of claim 10, wherein the slot is formed on at least one of the first and second surfaces of the first and second coil assemblies.

13. The control valve of claim 10, wherein the slot is formed on at least one of the first and second surfaces and at least one or third and fourth surfaces.

14. The control valve of claim 10, further comprising a bolt extending via the through-hole of the spool.

15. The control valve of claim 10, wherein an area of the main surface portion is larger than that of the slot.

16. The control value of claim 10; wherein the slot comprises a pair of slots arranged on opposite sides of the through hole.

17. The control valve of claim 10, wherein the slot is narrower than a diameter of the through-hole.

18. The control valve of claim 10, wherein the main surface portion is substantially flat.

19. The control valve of claim 10, wherein the main surface portion is substantially symmetric with respect to the slot.

20. A fuel injector, comprising:

a control valve having an inlet port and working ports;

a first coil assembly on a first side of the control valve, the first coil assembly having a first surface;

a second coil assembly on a second side of the control valve, the second coil assembly having a second surface;

a spool positioned within the control valve and configured to move between the first and second surfaces, the spool having a third surface facing the first surface, a fourth surface facing the second surface and a through hole extending from the third surface to the fourth surface;

an intensifier chamber having a piston and plunger assembly, the intensifier chamber being in fluid communication with the working ports;

a high pressure fuel chamber arranged below a portion of the plunger assembly; and a needle chamber having a needle responsive to an increased fuel pressure created in the high pressure fuel chamber, wherein at least one of the first, second, third and fourth surfaces has a surface configuration comprising a main surface portion and a slot longitudinally extending over an entire diameter of the surface configuration except for the through hole, thereby dividing the main surface into two halves, wherein the slot is formed on at least one of the third and fourth surfaces of the spool.

* * * * *